US010390574B2

(12) United States Patent
Chen

(10) Patent No.: US 10,390,574 B2
(45) Date of Patent: Aug. 27, 2019

(54) HAND COVER SYSTEM

(71) Applicant: Li Ray Chen, Taipei (TW)

(72) Inventor: Li Ray Chen, Taipei (TW)

( * ) Notice: Subject to any disclaimer, the term of this patent is extended or adjusted under 35 U.S.C. 154(b) by 174 days.

(21) Appl. No.: 15/461,867

(22) Filed: Mar. 17, 2017

(65) Prior Publication Data

US 2018/0263312 A1 Sep. 20, 2018

(51) Int. Cl.

| | |
|---|---|
| ***A41D 19/00*** | (2006.01) |
| ***A41D 19/01*** | (2006.01) |
| ***A41F 1/00*** | (2006.01) |
| ***A41F 1/06*** | (2006.01) |

(52) U.S. Cl.

CPC ..... *A41D 19/0013* (2013.01); *A41D 19/0006* (2013.01); *A41D 19/0017* (2013.01); *A41D 19/0048* (2013.01); *A41D 19/01* (2013.01); *A41F 1/002* (2013.01); *A41F 1/06* (2013.01)

(58) Field of Classification Search

CPC ..... A41D 19/0013; A41D 19/0017; A41D 19/01; A41D 19/0048; A41D 19/0006; A41D 19/00; A41D 19/001; A41D 19/0034; A41D 13/081; A41D 13/085; A41F 1/06; A41F 1/002

USPC ..... 2/158

See application file for complete search history.

(56) References Cited

U.S. PATENT DOCUMENTS 428,115 A * 5/1890 Levy ..... A41D 19/01 2/158
2,274,335 A * 2/1942 Kennedy ..... A41D 19/01 2/158
2,315,889 A * 4/1943 Wells ..... A41D 19/0017 2/158
2,318,785 A * 5/1943 Kopplin ..... A41D 19/01 2/158
2,451,837 A * 10/1948 La Londe ..... A41D 19/01 2/158
9,521,873 B1 12/2016 Mignone (Continued)

FOREIGN PATENT DOCUMENTS

| | | |
|---|---|---|
| CN | 3946595 | 12/2014 |
| DE | 102013017003 A1 * | 4/2015 |
| TW | M 496497 | 3/2015 |

OTHER PUBLICATIONS

English language translation of DE 102013017003 (Pub Apr. 2015). 11 pgs.*

(Continued)

*Primary Examiner* — Amy Vanatta

(74) *Attorney, Agent, or Firm* — John D. Tran; Rhema Law Group

(57) ABSTRACT

A hand cover system can include: an exterior structure including a finger sheath and a thumb sheath; a sealing structure coupled to the finger sheath of the exterior structure, the sealing structure including magnets, the sealing structure enabling an open configuration and a closed configuration; and wherein: the open configuration includes the sealing structure split apart and the exterior structure folded back on itself for allowing a user's hand to be exposed from between the sealing structure, and the closed configuration includes the magnets of the sealing structure maintaining the sealing structure together for covering the user's hand.

20 Claims, 7 Drawing Sheets

(56) References Cited

U.S. PATENT DOCUMENTS

| | | | | |
|---|---|---|---|---|
| 2005/0102732 | A1* | 5/2005 | Nakagawa | A41D 19/0017 2/161.1 |
| 2006/0260022 | A1* | 11/2006 | Vaughn | A41D 19/0017 2/163 |
| 2015/0245675 | A1 | 1/2015 | Chinquee | |
| 2015/0135419 | A1 | 5/2015 | Moore et al. | |
| 2016/0128400 | A1* | 5/2016 | Cookus | A41D 19/001 2/158 |
| 2016/0249694 | A1* | 9/2016 | Sullivan | A41D 19/0048 2/158 |
| 2017/0273375 | A1* | 9/2017 | Tang | A41D 19/01529 |

OTHER PUBLICATIONS https://www.youtube.com/watch?v=dwCtPuwPZIs Seirus Innovation, Magnemask Featurette, Magnemask, May 31, 2016.

* cited by examiner

HAND COVER SYSTEM

CROSS-REFERENCE TO RELATED APPLICATIONS

This is a Continuation-in-Part of U.S. patent application Ser. No. 14/862,166 filed on Sep. 23, 2015, and claims priority benefit to all common subject matter. The content of this application is incorporated herein by reference in its entirety.

TECHNICAL FIELD

This disclosure relates to hand cover, more particularly to hand cover or hand cover systems with re-sealable openings.

BACKGROUND

Hand Cover Systems has found ubiquitous implementation for protection against cuts, abrasion, hazardous materials, and severe environments. With this acceptance, many short comings have been discovered including reduced dexterity, reduced flexibility, and reduced tactile feedback.

Some previous solutions have attempted to reduce protection in order to increase dexterity, flexibility, or tactile feedback with only partial success and decreased overall protection. Other solutions have focused on improving the materials used; however, this has led to only partial success and at prohibitively increased costs.

Solutions have been long sought but prior developments have not taught or suggested any complete solutions, and solutions to these problems have long eluded those skilled in the art. Thus there remains a considerable need for hand cover systems that can provide increased dexterity, increased flexibility, and increased tactile feedback.

SUMMARY

A hand cover system, providing significantly increased dexterity, increased flexibility, and increased tactile feedback, is disclosed. The hand cover system can include: an exterior structure including a finger sheath and a thumb sheath; a sealing structure coupled to the finger sheath of the exterior structure, the sealing structure including magnets, the sealing structure enabling an open configuration and a closed configuration; and wherein: the open configuration includes the sealing structure split apart and the exterior structure folded back on itself for allowing a user's hand to be exposed from between the sealing structure, and the closed configuration includes the magnets of the sealing structure maintaining the sealing structure together for covering the user's hand. The sealing structure being significantly faster to open and close the hand cover system versus traditional methods such as a zipper.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The hand cover system is illustrated in the figures of the accompanying drawings which are meant to be exemplary and not limiting, in which like reference numerals are intended to refer to like components, and in which.

DETAILED DESCRIPTION

Figure 1:
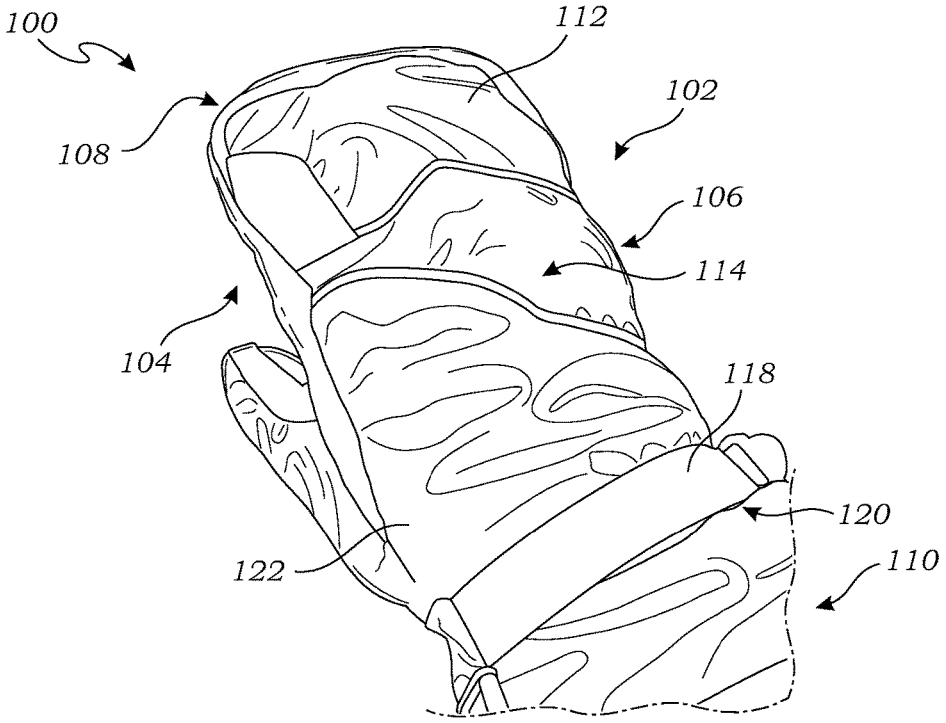
FIG. 1 is an isometric view of a top side of the hand cover system in a first embodiment and in a closed configuration.

In the following description, reference is made to the accompanying drawings that form a part hereof, and in which are shown by way of illustration, embodiments in which the hand cover system may be practiced. It is to be understood that other embodiments may be utilized and structural changes may be made without departing from the scope of the hand cover system.

When features, aspects, or embodiments of the hand cover system are described in terms of steps of a process, an operation, a control flow, or a flow chart, it is to be understood that the steps can be combined, performed in a different order, deleted, or include additional steps without departing from the hand cover system as described herein.

The hand cover system is described in sufficient detail to enable those skilled in the art to make and use the hand cover system and provide numerous specific details to give a thorough understanding of the hand cover system; however, it will be apparent that the hand cover system may be practiced without these specific details.

In order to avoid obscuring the hand cover system, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGs. Generally, the hand cover system can be operated in any orientation.

As used herein, the term system is defined as a device or method depending on the context in which it is used. For expository purposes, the term "top" as in top surface, top side, top portion, or top area is used herein to describe areas and surfaces that face in a similar direction as those facing away from, or opposite, the palm when the hand cover system is extended straight regardless of its orientation. The term "lateral" as in lateral side lateral motion is used herein to mean a direction or area perpendicular to the top as just defined.

The term "bottom" is used herein for surfaces that face the opposite of the top as just defined. The term "front" is used herein to describe portions near, or intended for, fingers, while the term "back" is used herein to describe portions near, or intended for, a wrist when the hand cover system is extended straight regardless of its orientation.

The term "outer" is used herein to mean surfaces or structures positioned, relative to other elements being described, further away from a user when the hand cover system is being worn in a closed configuration regardless of orientation. The term "inner" is used herein to mean surfaces opposite to the outer as just defined.

Referring now to FIG. 1, therein is shown an isometric view of a top side of the hand cover system 100 in a first embodiment and in a closed configuration. The hand cover system 100 is depicted having a top side 102 a bottom side 104 and lateral sides 106 and is illustrated as a right hand glove.

The hand cover system 100 is further depicted having a front area 108 and a back area 110. The front area 108 is depicted as a mitten where fingers of a user are intended to be placed in or reside within a single finger sheath 112.

The finger sheath 112 can extend from a middle area 114, between the front area 108 and the back area 110, to the front area 108. The middle area 114 can also include a thumb sheath 116 extending out from the middle area 114 toward the front area 108 for housing and protecting a user's thumb.

The back area 110 can include straps 118 and elastics 120 for constricting the hand cover system 100 onto a user's wrist. The hand cover system 100 is shown having an exterior structure 122.

The exterior structure 122 can be the structures of the hand cover system 100 that provide protection from the external environment when the hand cover system 100 is in the closed configuration. The exterior structure 122 can include linings and multiple layers intended to provide protection from the external environment when the hand cover system 100 is in the closed configuration.

For instance, the exterior structure 122 is contemplated to include an outer external layer providing abrasion and moisture resistance and further to include inner layers providing insulation and padding.

Figure 2:
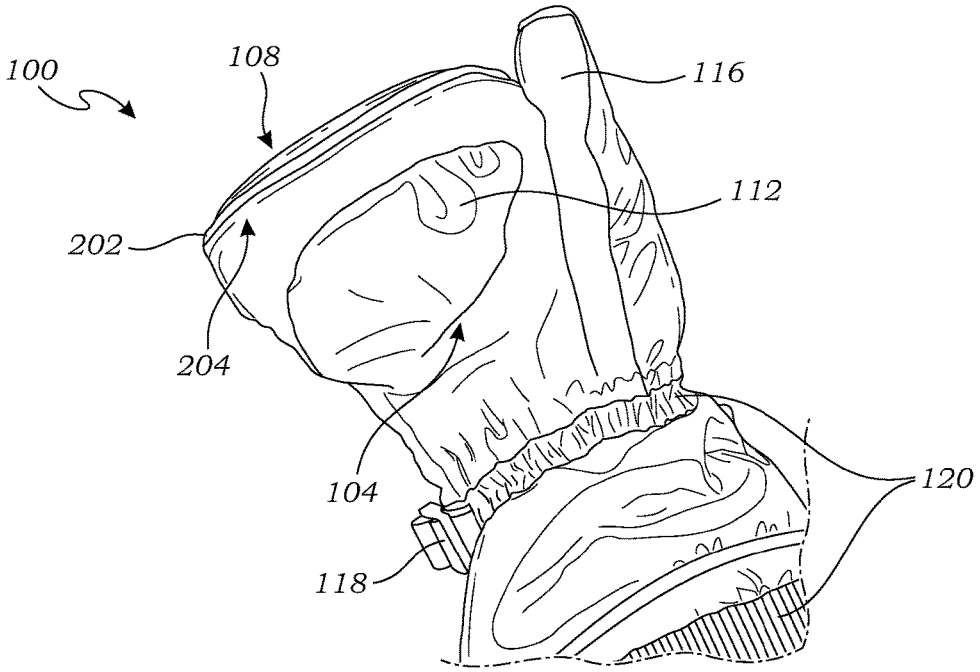
FIG. 2 is an isometric view of a bottom side and front side of the hand cover system of FIG 1.

Referring now to FIG. 2, therein is shown an isometric view of a bottom side and front side of the hand cover system 100 of FIG. 1. The hand cover system 100 is depicted having the bottom side 104 of the hand cover system 100 curving in toward the front area 108 to provide a side view of the finger sheath 112.

The finger sheath 112 is shown having sealing structures 202 on the lateral sides 106 and wrapping around the front area 108. The thumb sheath 116 is not depicted having the sealing structures 202.

It has been discovered that the sealing structures 202 can be piping or other sealing bodies and can include magnets 204 for ensuring the front area 108 remains in the closed configuration until a user applies the appropriate force to change the hand cover system 100 into an open configuration. It is further discovered that ensuring that the thumb sheath 116 does not include the sealing structures 202 has been found to increase protection of the thumb without sacrificing the ability of a user to remove the thumb through the finger sheath 112 if needed.

The bottom side 104 near the back area 110 is further shown including the straps 118 and the elastics 120.

Figure 3:
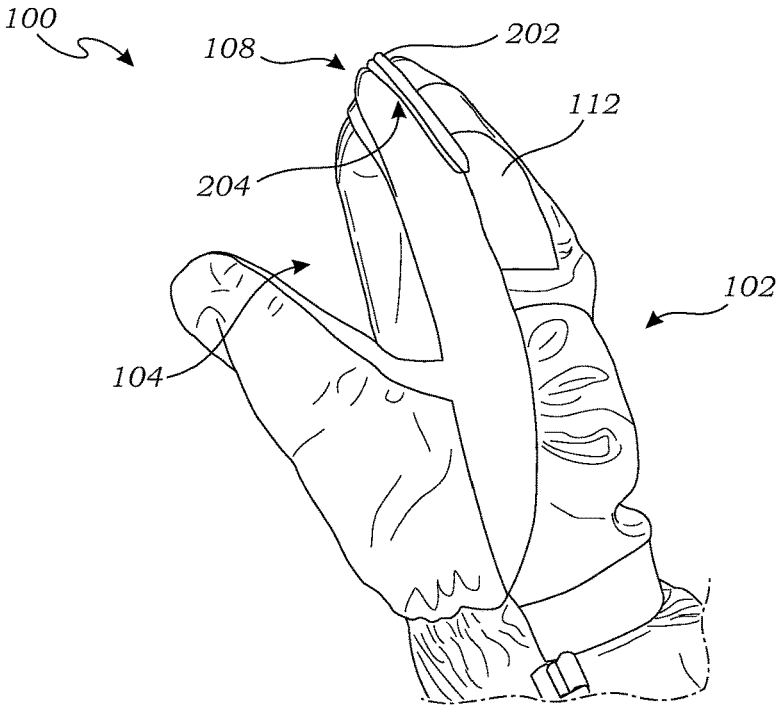
FIG. 3 is an isometric view of a side of the hand cover system of FIG. 1.

Referring now to FIG. 3, therein is shown an isometric view of a side of the hand cover system 100 of FIG. 1. The hand cover system 100 is shown having the sealing structures 202 sealed with the magnets 204. The sealing structures 202 can be formed in the finger sheath 112 near the front area 108. As can be seen, the sealing structure 202 is located closer to the top side 102 than to the bottom side 104.

Figure 4:
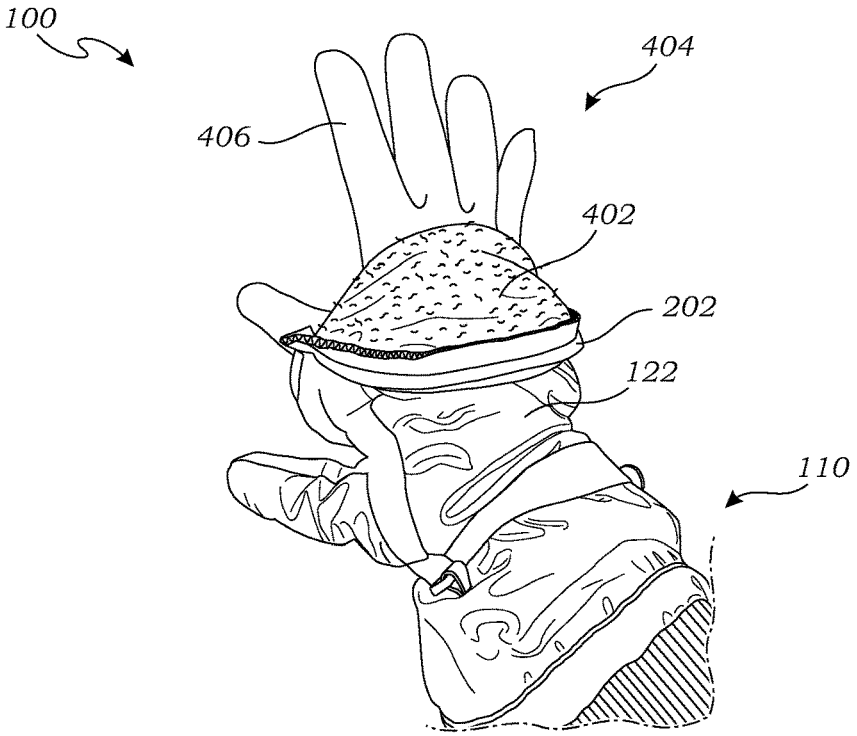
FIG. 4 is an isometric view of the top side of the hand cover system of FIG. 1 in an open configuration.

Referring now to FIG. 4, therein is shown an isometric view of the top side of the hand cover system 100 of FIG. 1 in an open configuration. The open configuration of the hand cover system 100 depicts the top side 102 and the bottom side 104 of the exterior structure 122 folded back on itself to expose inner padding structures 402 of the exterior structure 122.

A user's hand 404 is depicted extended from the sealing structure 202 having an interior lining 406 covering thereover. The sealing structures 202 have been split apart allowing the user's hand 404 to extend therefrom.

The interior lining 406 is depicted as a thinner and fingered glove providing some protection from the external environment but providing greatly enhanced dexterity and tactile feedback for the user. As will be appreciated, the entire hand cover system 100 can be shifted backward toward the back area 110 and up the user's arm so that the user's hand 404 can fully extend out of the sealing structure 202.

Figure 5:
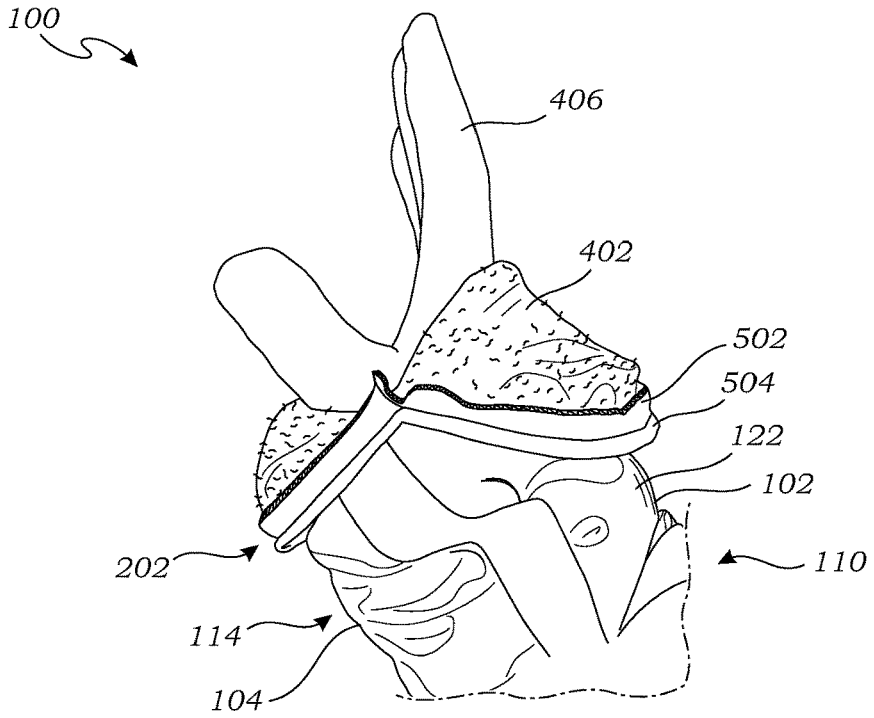
FIG. 5 is an isometric view of the side of the hand cover system of FIG. 4.

Referring now to FIG. 5, therein is shown an isometric view of the side of the hand cover system 100 of FIG. 4. The interior lining 406 can be affixed or attached to the inner padding structures 402 of the exterior structure 122 by velcro, magnets, zippers, or stitching.

The interior lining 406 can be attached to the exterior structure 122 near the back area 110 or near the middle area 114. The sealing structures 202 are depicted having an inner extension 502 and an outer edge 504 folded along an axis.

The outer edge 504 can contain the magnets 204 of FIG. 2 and can be a piping like structure for ensuring abrasion resistance. The inner extension 502 can be a lining extending in toward the interior lining 406 from the outer edge 504 and can provide a smooth transition, moisture barrier, or even a fold for locking the hand cover system 100 into the closed configuration by placing the inner extension 502 of the sealing structure 202 underneath the interior lining 406 of the user's hand 404 of FIG. 4.

Figure 6:
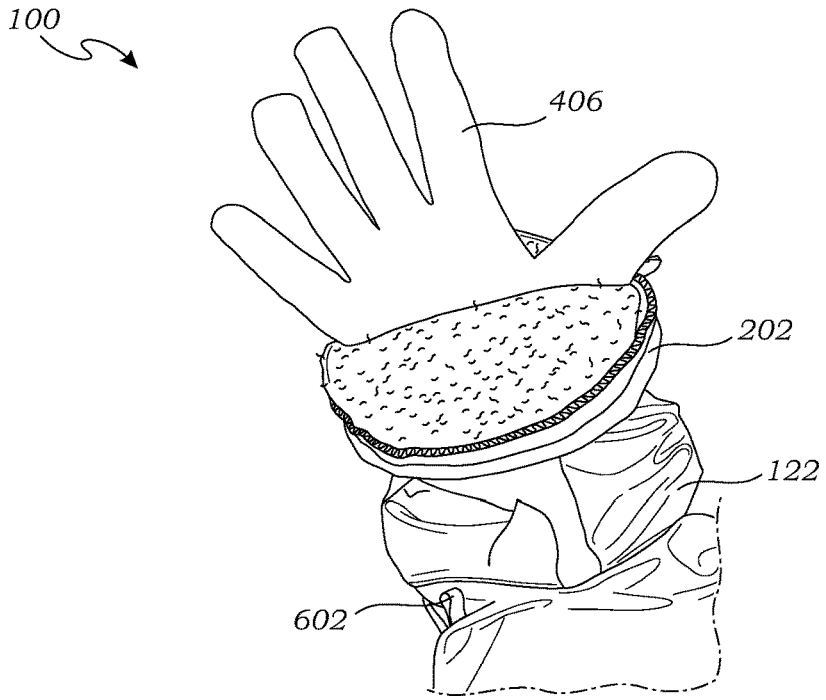
FIG. 6 is an isometric view of the bottom side of the hand cover system of FIG. 4.

Referring now to FIG. 6, therein is shown an isometric view of the bottom side of the hand cover system 100 of FIG. 4. The interior lining 406 is depicted having each of the user's fingers individually covered.

And the interior lining 406 is extended out of the sealing structure 202 up to the base of the thumb of the user. The exterior structure 122 is shown having a loop 602 attached thereto.

Figure 7:
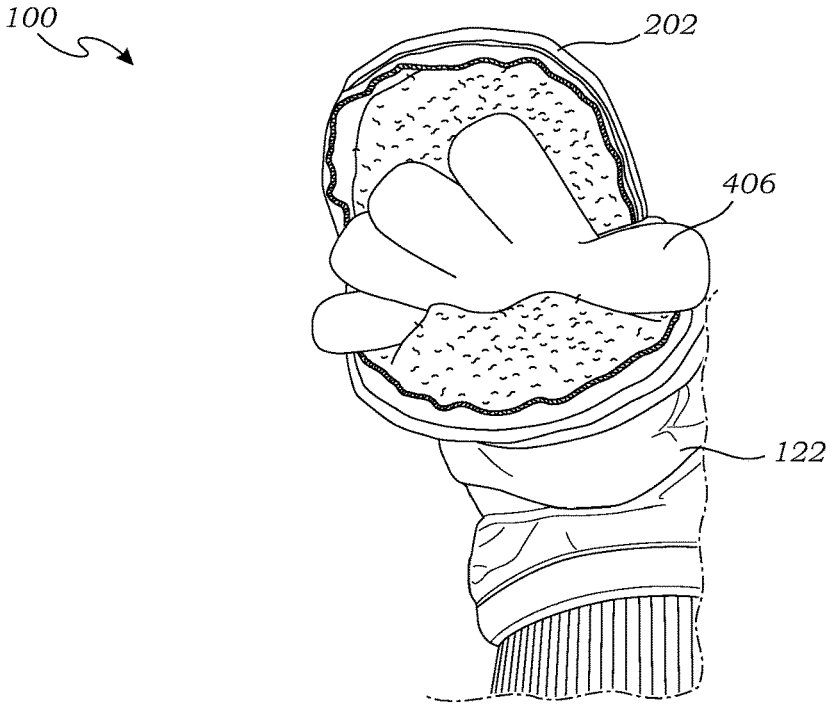
FIG. 7 is an isometric view of the bottom side and front side of the hand cover system of FIG. 4 with the interior lining partially retracted into the exterior structure.

Referring now to FIG. 7, therein is shown an isometric view of the bottom side and front side of the hand cover system of FIG. 4 with the interior lining 406 partially retracted into the exterior structure 122. In contrast to the depiction of the exterior structure 122 in FIGS. 5 and 6, the exterior structure 122 is not depicted in FIG. 7 to be folded back onto itself.

Instead, the exterior structure 122 is shown more or less straight with the sealing structure 202 opened and split apart. In this depiction, the interior lining 406 can be seen only partially extending from the sealing structure 202 while also being partially retracted within the sealing structure 202 and the exterior structure 122.

It has been discovered that enabling the interior lining 406 to be extended in a variable or flexible manner with respect to the sealing structure 202 and the exterior structure 122, enables a much greater range of protection while simultaneously providing a greater range of dexterity and tactile feedback.

Figure 8:
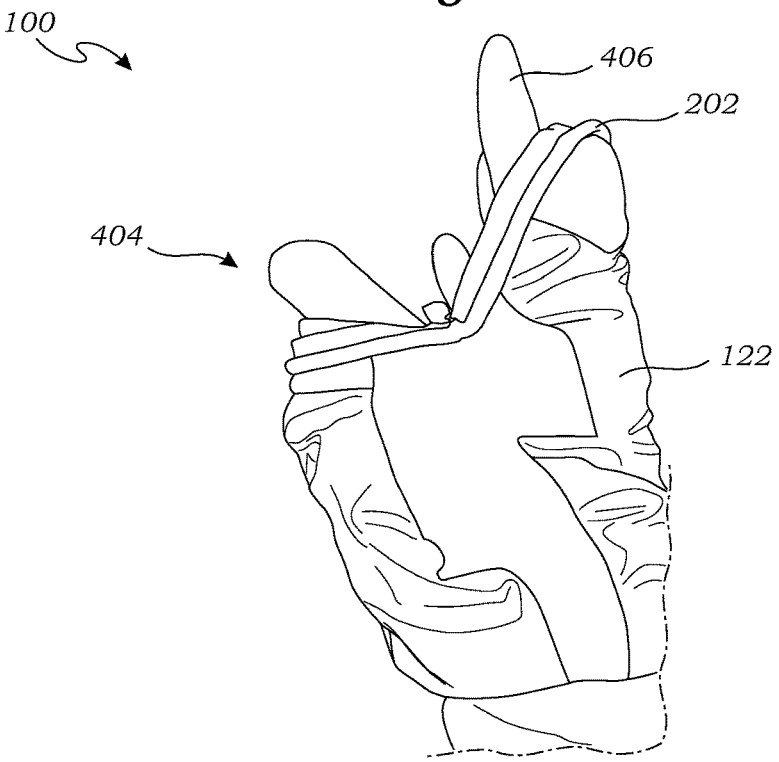
FIG. 8 is an isometric view of the side of the hand cover system of FIG. 7.

Referring now to FIG. 8, therein is shown an isometric view of the side of the hand cover system of FIG. 7. The exterior structure 122 can be seen wrinkled but not folded back on itself Further the interior lining 406 is depicted only partially extending out from the sealing structure 202 of the exterior structure 122. It will be appreciated that the exterior structure 122 can be placed closer to the user's hand 404 when the interior lining 406 is partially retracted into the sealing structure 202 than when the interior lining 406 is fully extended out as is depicted in FIGS. 5 and 6.

Figure 9:
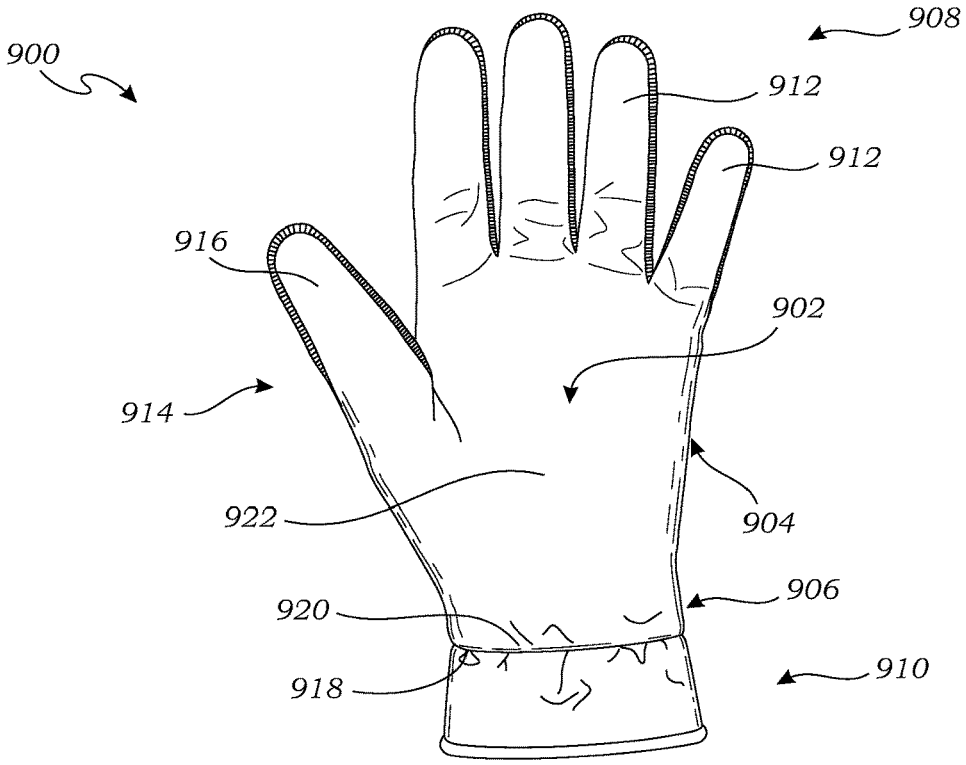
FIG. 9 is a top view of the hand cover system in a second embodiment and in a closed configuration.

Referring now to FIG. 9, therein is shown a top view of the hand cover system 900 in a second embodiment and in a closed configuration. The hand cover system 900 is depicted having a top side 902 a bottom side 904 and lateral sides 906 and is illustrated as a right hand glove.

The hand cover system 900 is further depicted having a front area 908 and a back area 910. The front area 908 is intended to have a user's fingers placed within individual finger sheaths 912.

The finger sheaths 912 can extend from a middle area 914, between the front area 908 and the back area 910, to the front area 908. The middle area 914 can also include a thumb sheath 916 extending out from the middle area 914 toward the front area 908 for housing and protecting a user's thumb.

The back area 910 can include straps 918 and elastics 920 for constricting the hand cover system 900 onto a user's wrist. The hand cover system 900 is shown having an exterior structure 922.

The exterior structure 922 can be the structures of the hand cover system 900 that provide protection from the external environment when the hand cover system 900 is in the closed configuration. The exterior structure 922 can include linings and multiple layers intended to provide protection from the external environment when the hand cover system 900 is in the closed configuration.

For instance, the exterior structure 922 is contemplated to include an outer external layer providing abrasion and moisture resistance and further to include inner layers providing insulation and padding.

Figure 10:
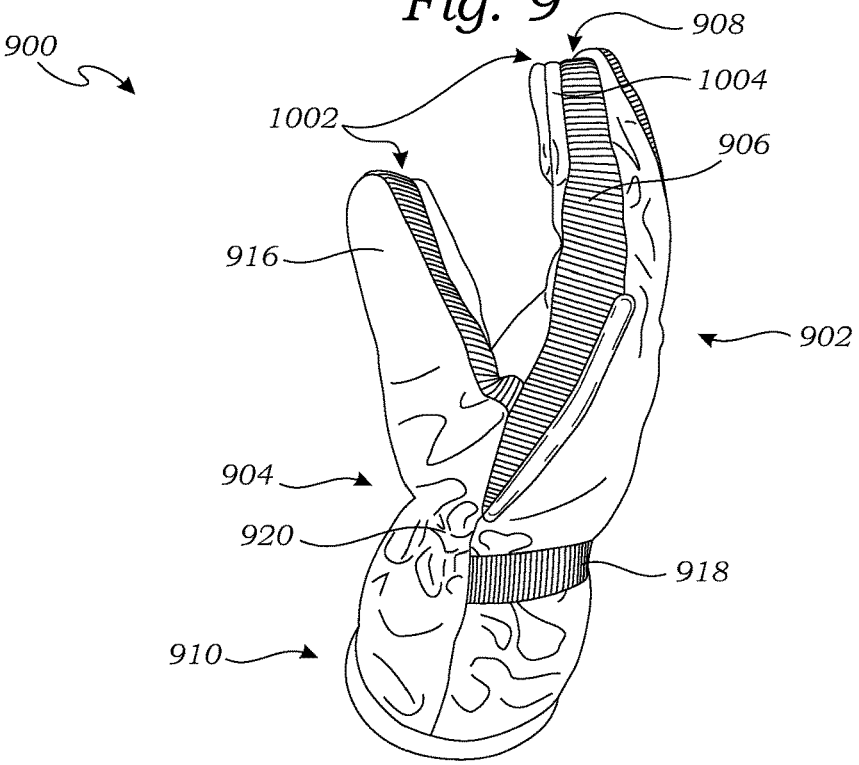
FIG. 10 is an isometric view of a side of the hand cover system of FIG. 9.

Referring now to FIG. 10, therein is shown an isometric view of a side of the hand cover system 900 of FIG. 9. The finger sheaths 912 are shown having sealing structures 1002 on the lateral sides 906 and wrapping around the front area 908 of the finger sheaths 912. The thumb sheath 916 is also depicted having the sealing structures 1002 near the front area 108 of the thumb sheath 116.

It has been discovered that the sealing structures 1002 can be piping or other sealing bodies and can include magnets 1004 for ensuring the front area 908 remains in the closed configuration until a user applies the appropriate force to change the hand cover system 900 into an open configuration.

The hand cover system 900 is shown having the sealing structures 1002 sealed with the magnets 1004. The sealing structures 1002 can be formed in the finger sheaths 912 near the front area 908. As can be seen, the sealing structure 1002 is located closer to the bottom side 104 than to the top side 102. The bottom side 904 near the back area 910 is further shown including the straps 918 and the elastics 920.

Figure 11:
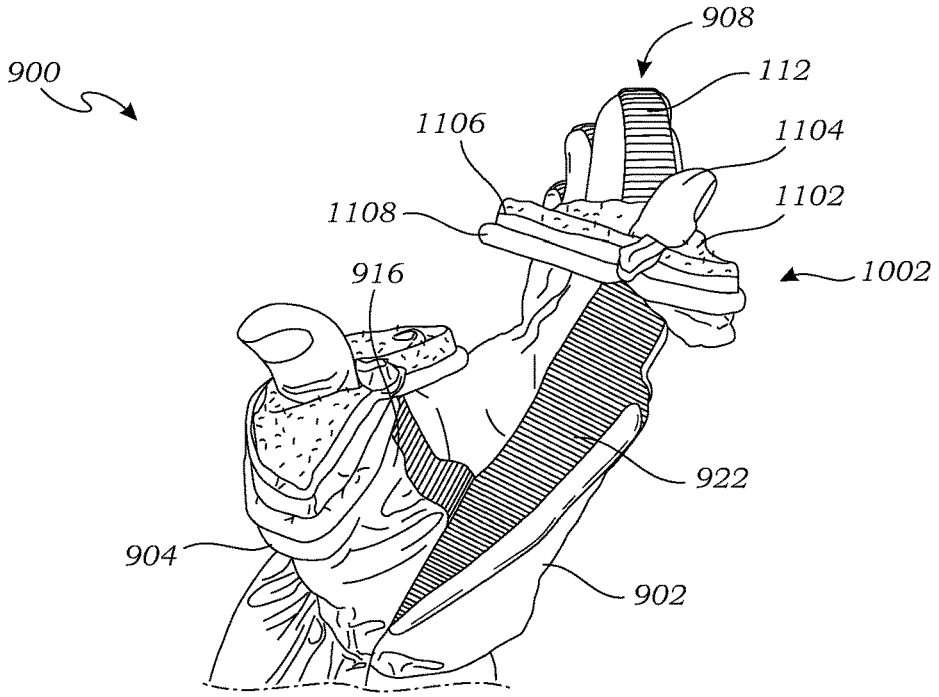
FIG. 11 is an isometric view of the side of the hand cover system of FIG. 10 in an open configuration.

Referring now to FIG. 11, therein is shown an isometric view of the side of the hand cover system 900 of FIG. 10 in an open configuration. The open configuration of the hand cover system 900 depicts the top side 902 and the bottom side 904 of the exterior structure 922 comprising the front area 908 of the finger sheaths 112 and the thumb sheath 116 folded back on itself to expose inner padding structures 1102 of the exterior structure 922.

A user's hand 1104 is depicted extended from the sealing structure 1002 fully exposed therefrom. The sealing structures 1002 have been split apart allowing the user's hand 1104 to extend therefrom.

It is contemplated that an interior lining could be implemented, as is with the first embodiment, as a thinner and fingered glove providing some protection from the external environment but providing greatly enhanced dexterity and tactile feedback for the user. As will be appreciated, the entire hand cover system 900 can be in a fixed position and not pushed backward toward the back area 910 or up the user's arm so that only the user's fingers will extend out of the sealing structure 1002. The sealing structures 1002 are depicted having an inner extension 1106 and an outer edge 1108.

The outer edge 1108 can contain the magnets 1004 of FIG. 10 and can be a piping like structure for ensuring abrasion resistance. The inner extension 1106 can be a lining extending in toward the interior lining 1106 from the outer edge 1108 and can provide a smooth transition, moisture barrier, or even a fold for locking the hand cover system 900 into the closed configuration by placing the inner extension 1106 of the sealing structure 1002 underneath the user's hand 1104.

Figure 12:
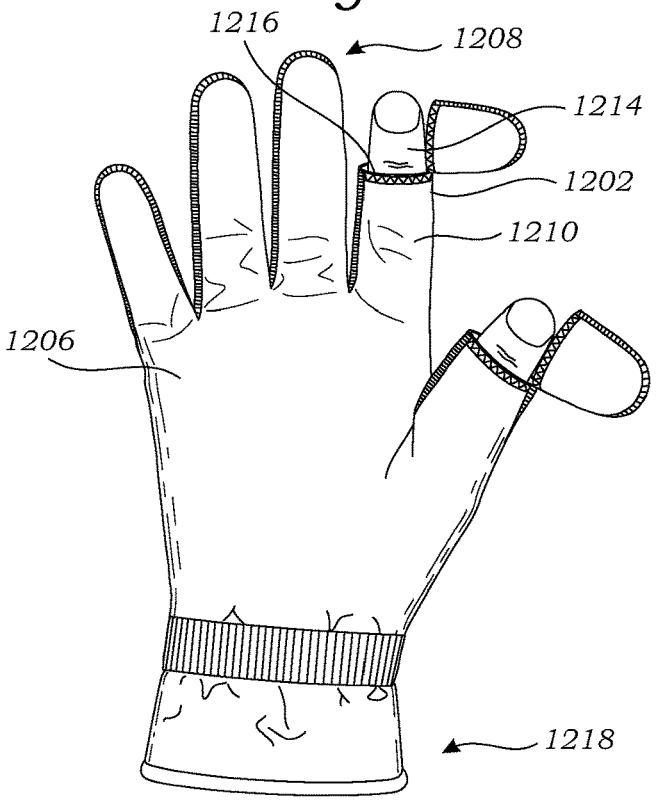
FIG. 12 is a top view of the hand cover system in a third embodiment and in an open configuration.

Referring now to FIG. 12, therein is shown a top view of the hand cover system 1200 in a third embodiment and in an open configuration. The open configuration of the hand cover system 1200 depicts lateral sides 1202 of an exterior structure 1206 comprising a front area 1208 of a finger sheath 1210 and a thumb sheath 1212 folded back on itself to expose a user's hand 1214.

The user's forefinger and thumb are depicted extended from sealing structures 1216 with only the tips of the forefinger and thumb exposed therefrom. The sealing structures 1216 have been split apart around the finger sheath 1210 and the thumb sheath 1212 allowing the user's hand 1214 to extend therefrom.

It is contemplated that an interior lining could be implemented, as is with the first embodiment, as a thinner and fingered glove providing some protection from the external environment but providing greatly enhanced dexterity and tactile feedback for the user. As will be appreciated, the entire hand cover system 1200 can be in a fixed position and not pushed backward toward a back area 1218 or up the user's arm so that only the user's fingers will extend out of the sealing structure 1216.

Figure 13:
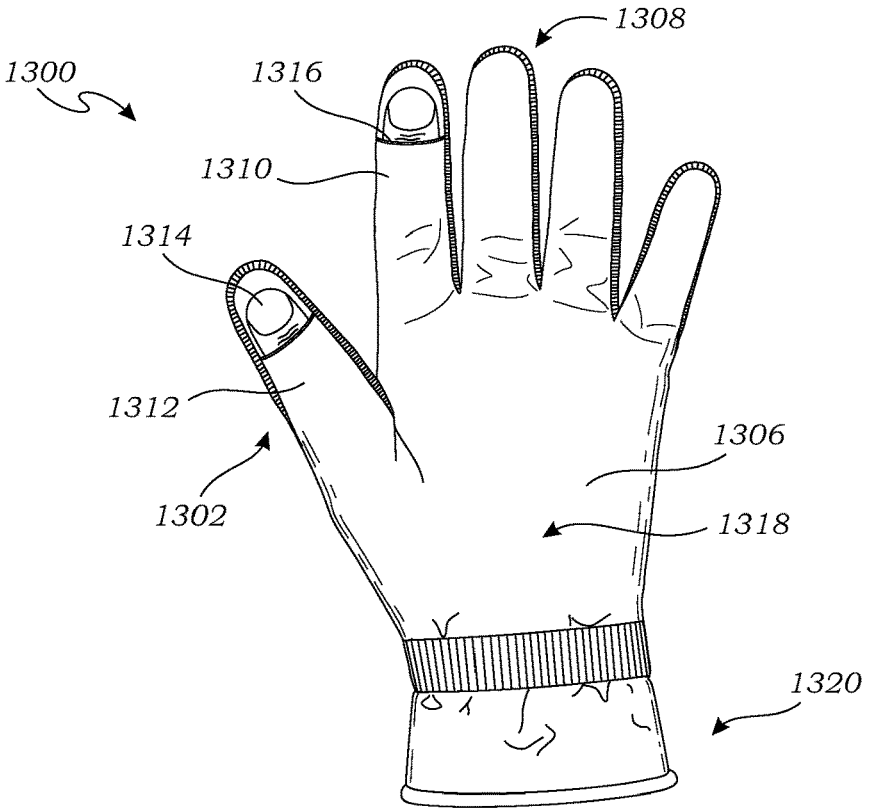
FIG. 13 is a top view of the hand cover system in a fourth embodiment and in an open configuration.

Referring now to FIG. 13, therein is shown a top view of the hand cover system 1300 in a fourth embodiment and in an open configuration. The open configuration of the hand cover system 1300 depicts bottom sides 1302 of an exterior structure 1306 comprising a front area 1308 of a finger sheath 1310 and a thumb sheath 1312 folded back on themselves to expose a user's hand 1314.

The user's forefinger and thumb are depicted extended from sealing structures 1316 with only the tips of the forefinger and thumb exposed therefrom. The sealing structures 1316 have been split apart around the finger sheath 1310 and the thumb sheath 1312 allowing the user's hand 1314 to extend therefrom. It is alternatively contemplated that a top side 1318 of the finger sheath 1310 and the thumb sheath 1312 could be folded back on itself leaving the pads of the user's forefinger and thumb exposed rather than the finger nail as is currently shown.

It is contemplated that an interior lining could be implemented, as is with the first embodiment, as a thinner and fingered glove providing some protection from the external environment but providing greatly enhanced dexterity and tactile feedback for the user. As will be appreciated, the entire hand cover system 1300 can be in a fixed position and not pushed backward toward a back area 1320 or up the user's arm so that only the user's fingers will extend out of the sealing structure 1316.

Figure 14:
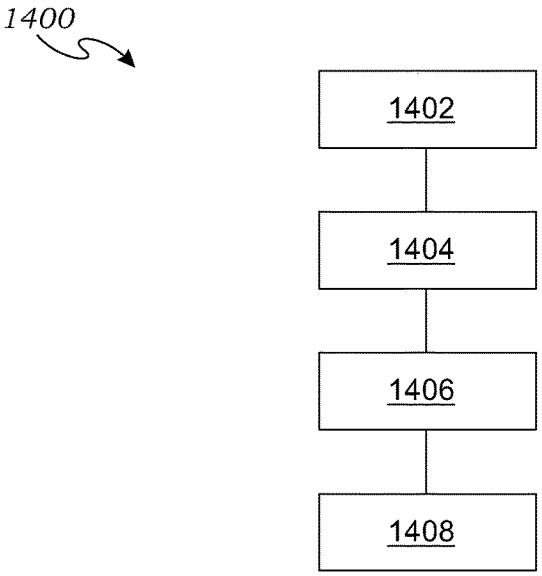
FIG. 14 is a flowchart for manufacturing the hand cover system.

Referring now to FIG. 14, therein is shown a flowchart 1400 for manufacturing the hand cover system. The hand cover system can be manufactured by: providing an exterior structure including a finger sheath, a thumb sheath, a strap and elastics, the strap and elastics near a back area of the exterior structure, and the finger sheath and thumb sheath extending from a middle area of the exterior structure to a front area of the exterior structure in a block 1402; affixing a sealing structure to the finger sheath of the exterior structure, the sealing structure including magnets, an inner extension, and an outer edge, the sealing structure enabling an open configuration and a closed configuration in a block 1404; and wherein affixing the sealing structure enabling the open configuration includes affixing the sealing structure enabling the open configuration including the sealing structure being split apart and the exterior structure folded back on itself for allowing a user's hand to be exposed from between the sealing structure in a block 1406, and wherein affixing the sealing structure enabling the closed configuration includes affixing the sealing structure enabling the closed configuration having the magnets of the sealing structure maintaining the sealing structure together for covering the user's hand with the outer edge exposed and the inner extension contained within the exterior structure in a block 1408.

Thus, it has been discovered that the hand cover system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the hand cover system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A hand protection system comprising:

an exterior structure including a finger sheath and a thumb sheath;

a sealing structure coupled to the finger sheath of the exterior structure, the sealing structure including an inner extension and an outer edge, the outer edge including magnets in a piping, the sealing structure enabling an open configuration and a closed configuration; and wherein:

the open configuration includes the sealing structure split apart and the exterior structure folded back on itself for allowing a user's hand to be exposed from between the sealing structure, and the closed configuration includes the magnets of the sealing structure maintaining the sealing structure together for covering the user's hand, and the inner extension extended in from the outer edge for providing a smooth transition, a moisture barrier, and a fold for locking the protection system into the closed configuration by being configured to be placed underneath the user's hand.

2. The system of claim 1 wherein the sealing structure is coupled to a lateral side of a front area of the finger sheath, and the sealing structure is configured to fold along an axis.

3. The system of claim 1 further comprising an interior lining within the exterior structure, the interior lining exposed based on the sealing structure being in the open configuration.

4. The system of claim 1 further comprising an inner padding structure affixed to the exterior structure.

5. The system of claim 1 wherein the finger sheath is a mitten for covering multiple user's fingers within the finger sheath.

6. A hand protection system comprising:

an exterior structure including a finger sheath, a thumb sheath, a strap and elastics, the strap and elastics near a back area of the exterior structure, and the finger sheath and thumb sheath extending from a middle area of the exterior structure to a front area of the exterior structure;

a sealing structure coupled to the finger sheath of the exterior structure, the sealing structure including an inner extension, and an outer edge, the outer edge including magnets in a piping, the sealing structure enabling an open configuration and a closed configuration; and wherein:

the open configuration includes the sealing structure split apart and the exterior structure folded back on itself for allowing a user's hand to be exposed from between the sealing structure, and the closed configuration includes the magnets of the sealing structure maintaining the sealing structure together for covering the user's hand with the outer edge exposed and the inner extension contained within the exterior structure, the inner extension extended in from the outer edge for providing a smooth transition, a moisture barrier, and a fold for locking the protection system into the closed configuration by being configured to be placed underneath the user's hand.

7. The system of claim 6 wherein the sealing structure is configured to split laterally apart and fold to a lateral side of the exterior structure.

8. The system of claim 6 further comprising a second sealing structure coupled to the thumb sheath.

9. The system of claim 6 wherein the sealing structure is configured to split apart and fold to a top side of the exterior structure.

10. The system of claim 6 wherein the finger sheath is an individual finger sheath for an individual finger.

11. A method for manufacturing a hand protection system comprising:

providing an exterior structure including a finger sheath and a thumb sheath formed therein;

affixing a sealing structure to the finger sheath of the exterior structure, the sealing structure including an inner extension and an outer edge, the outer edge including magnets in a piping, the sealing structure enabling an open configuration and a closed configuration; and wherein:

the open configuration includes the sealing structure split apart and the exterior structure folded back on itself for allowing a user's hand to be exposed from between the sealing structure, and the closed configuration includes the magnets of the sealing structure maintaining the sealing structure together for covering the user's hand, and the inner extension extended in from the outer edge for providing a smooth transition, a moisture barrier, and a fold for locking the protection system into the closed configuration by being configured to be placed underneath the user's hand.

12. The method of claim 11 wherein affixing the sealing structure includes affixing the sealing structure to a lateral side of a front area of the finger sheath, and the sealing structure is configured to fold along an axis.

13. The method of claim 11 further comprising affixing an interior lining within the exterior structure, the interior lining exposed based on the sealing structure being in the open configuration.

14. The method of claim 11 further comprising affixing an inner padding structure to the exterior structure.

15. The method of claim 11 wherein providing the exterior structure includes providing the exterior structure including the finger sheath structured as a mitten for covering multiple user's fingers within the finger sheath.

16. The method of claim 11 wherein:

providing the exterior structure further includes providing the exterior structure having a strap and elastics, the strap and elastics near a back area of the exterior structure, and the finger sheath and thumb sheath extending from a middle area of the exterior structure to a front area of the exterior structure; and affixing the sealing structure includes affixing the sealing structure including an inner extension, and an outer edge, the outer edge exposed and the inner extension contained within the exterior structure based on the hand protection system being in the closed configuration.

17. The method of claim 16 wherein affixing the sealing structure includes affixing the sealing structure configured to split laterally apart and fold to a lateral side of the exterior structure.

18. The method of claim 16 further comprising affixing a second sealing structure to the thumb sheath.

19. The method of claim 16 wherein affixing the sealing structure includes affixing the sealing structure configured to split apart and fold to a top side of the exterior structure.

20. The method of claim 16 wherein providing the exterior structure includes providing the exterior structure including the finger sheath structured as an individual finger sheath for an individual finger.

* * * * *